US010000926B1

(12) United States Patent
Morfin

(10) Patent No.: US 10,000,926 B1
(45) Date of Patent: Jun. 19, 2018

(54) RETRACTABLE ROOF SYSTEM

(71) Applicant: Jesus Morfin, Baytown, TX (US)

(72) Inventor: Jesus Morfin, Baytown, TX (US)

( * ) Notice: Subject to any disclaimer, the term of this patent is extended or adjusted under 35 U.S.C. 154(b) by 0 days. days.

(21) Appl. No.: 15/820,799

(22) Filed: Nov. 22, 2017

Related U.S. Application Data

(60) Provisional application No. 62/425,350, filed on Nov. 22, 2016.

(51) Int. Cl.
*E04B 7/16* (2006.01)
*E04D 5/00* (2006.01)
*E04D 13/035* (2006.01)

(52) U.S. Cl.
CPC ..... *E04B 7/166* (2013.01); *E04D 5/00* (2013.01); *E04D 13/035* (2013.01)

(58) Field of Classification Search
CPC ..... E04B 7/166; E04D 13/035; E04D 5/00; B60P 3/34; B60P 3/341
USPC ..... 52/6, 64–66
See application file for complete search history.

(56) References Cited

U.S. PATENT DOCUMENTS 4,175,361 A * 11/1979 Kumode ..... E04B 1/34305 52/66
4,387,533 A * 6/1983 Green ..... A01G 9/22 47/17
4,577,436 A * 3/1986 Dalle ..... A01G 9/22 47/17
4,672,889 A * 6/1987 Lynch ..... A01G 9/242 454/364
4,716,691 A * 1/1988 Allen ..... E04B 1/34305 49/40
4,831,792 A * 5/1989 Berger ..... E04B 1/32 52/6
5,063,730 A * 11/1991 Muramoto ..... E04B 1/34305 52/6
5,778,603 A * 7/1998 Reppas ..... E04B 7/166 52/6
5,896,708 A * 4/1999 Doi ..... E04B 7/166 52/66
5,904,003 A * 5/1999 Stephen ..... E04H 3/14 52/2.18

(Continued)

*Primary Examiner* — Brian E Glessner
*Assistant Examiner* — Adam G Barlow
(74) *Attorney, Agent, or Firm* — Richard G. Eldredge; Eldredge Law Firm

(57) ABSTRACT

A retractable roof system includes a support structure, having a first vertical leg, a second vertical leg, a third vertical leg, and a fourth vertical leg extending upward from a ground surface; a first guide track extending from the first vertical leg to the second vertical leg; a second guide track extending from the third leg to the fourth leg; a first support beam connecting the first vertical leg and the third vertical leg; and a second support beam connecting the second vertical leg and the fourth vertical leg; a roof retractably secured on the support structure, the roof having: a frame having a first edge aligned with the first track and a second edge aligned with the second track; rollers connected to the first edge and the second edge to slidingly engage with the first track and the second track; and a flexible roofing material secured on the roof frame; a pulley attached to the first end of the frame; force exerted on the pulley pulls a set of the rollers towards a center of the roof, causing a first end of the frame to retract.

9 Claims, 7 Drawing Sheets

(56) References Cited

U.S. PATENT DOCUMENTS

| | | | | |
|---|---|---|---|---|
| 6,260,308 | B1 * | 7/2001 | Looney | A01G 9/227 52/63 |
| 6,843,019 | B2 * | 1/2005 | Mercurio | A01G 9/242 47/17 |
| 7,263,805 | B2 * | 9/2007 | Chapus | E04H 3/165 135/906 |
| 7,637,060 | B2 * | 12/2009 | Starheim | E06B 3/01 296/183.1 |
| 7,752,815 | B2 * | 7/2010 | Lauria | E04H 3/165 52/6 |
| 8,806,810 | B2 * | 8/2014 | Barragan Olaya | E04B 1/344 52/66 |
| 9,212,503 | B1 * | 12/2015 | Mentch | A01G 9/22 |
| 9,347,219 | B2 * | 5/2016 | Rasch | E04B 7/166 |
| 9,797,126 | B2 * | 10/2017 | Saggese | E04B 1/34305 |
| 2002/0129565 | A1 * | 9/2002 | Silberman | E04B 7/166 52/66 |
| 2009/0193725 | A1 * | 8/2009 | Harrisson | E04B 1/3442 52/66 |
| 2012/0000141 | A1 * | 1/2012 | Forsland | E04B 1/34305 52/66 |

* cited by examiner

RETRACTABLE ROOF SYSTEM

BACKGROUND

1. Field of the Invention

The present invention relates generally to roof systems, and more specifically, to a retractable roof system for convenient roof retraction and height alteration.

2. Description of Related Art

Roof systems are well known in the art and are effective means to provide shelter. For example, FIG. 1 depicts a conventional roof system 101 having a frame 103 with legs 105*a*, 105*b*, and a roof 107 secured to the frame 103 by support beams 109*a*, 109*b*, 109*c*. During use, the roof 107 provides a shelter and/or a covering for the user.

One of the problems commonly associated with system 101 is inflexibility. For example, system 101 is permanently placed in one position, providing cover and shelter for only that position. Altering the placement of system 101 generally requires additional equipment.

Accordingly, although great strides have been made in the area of roof systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
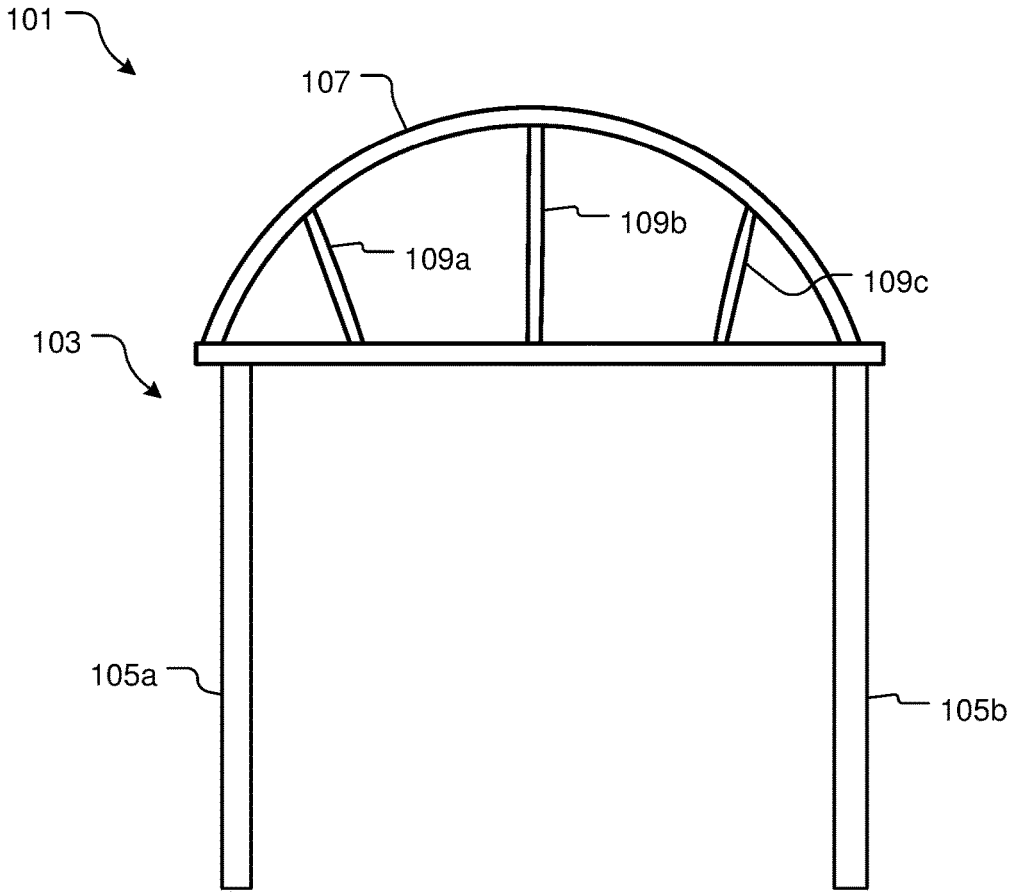
FIG. 1 (Prior Art)
FIG. 1 is a front view of a common roof system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional roof systems. Specifically, the present invention provides a means to alter the amount of roof coverage. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
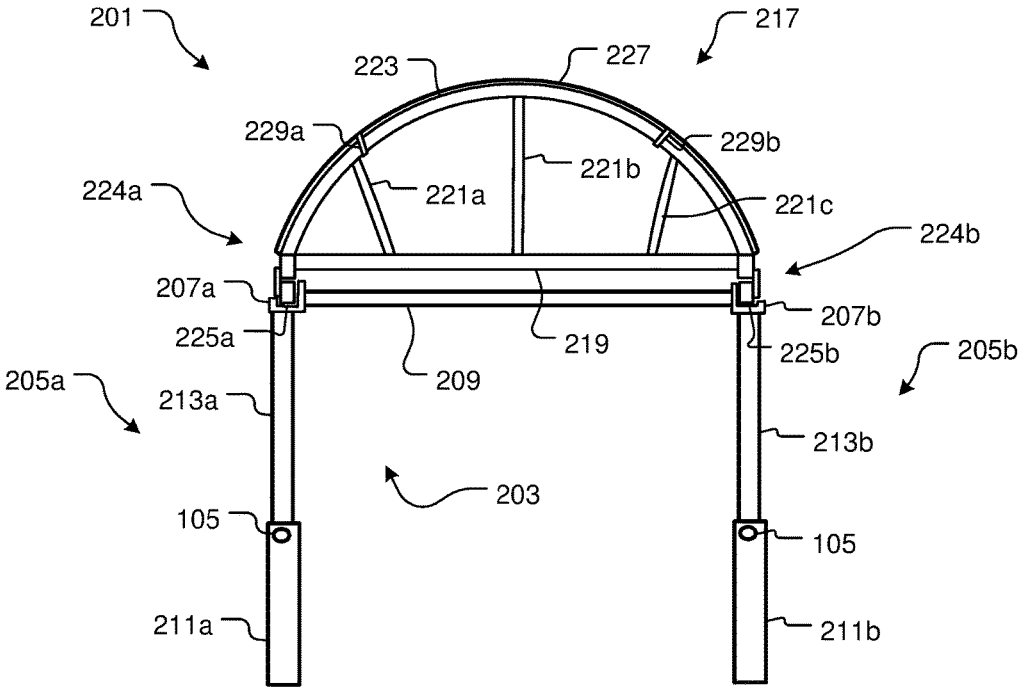
FIGS. 2A and 2B are front views of a retractable roof system in accordance with a preferred embodiment of the present application.
Figure 2B:
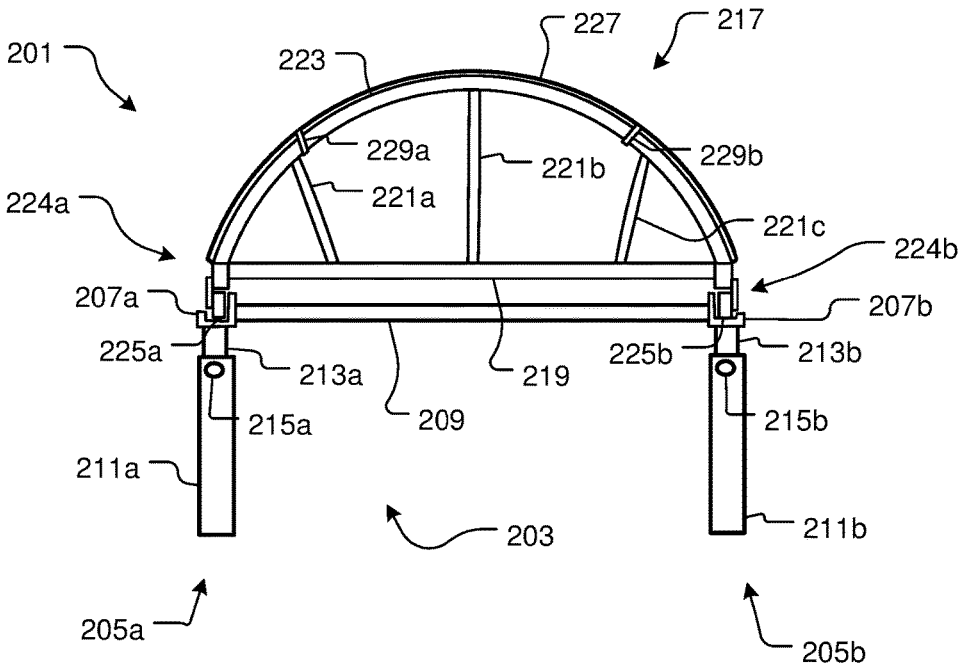

Referring now to the drawings wherein like reference characters identify corresponding or similar elements throughout the several views, FIGS. 2A and 2B depict front views of a retractable roof system 201 in accordance with a preferred embodiment of the present application. It will be appreciated that system 201 overcomes one or more of the above-listed problems commonly associated with conventional roof systems.

In the contemplated embodiment, system 201 includes a support structure 203 having a plurality of vertical legs 205*a*, 205*b* extending upward and connected to two guide tracks 207*a*, 207*b* running parallel with one another and one or more support beams 209 running perpendicular to guide tracks 207*a*, 207*b*. It is contemplated that legs 205*a*, 205*b* can further include elongated members 211*a*, 211*b* for resting on the ground, and rods 213*a*, 213*b* slidingly engaged with elongated members 211*a*, 211*b*, wherein rods 213*a*, 213*b* are secured at a height by a securing device 215*a*, 215*b* such as a bolt, thereby altering the height of support structure 203. It should be appreciated that various other telescoping means could be used to extend the height of the legs.

The preferred embodiment of system 201 further includes a roof 217 having a frame 219 with one or more support beam 221*a*, 221*b*, 221*c* connected to one or more arched beams 223. Frame 219 is slidingly engaged with guide tracks 207*a*, 207*b* at retraction points 224*a*, 224*b* by a plurality of rollers 225*a*, 225*b*. In the preferred embodiment, frame 219 supports a flexible roofing material 227 such as a tarp, wherein the roofing material 227 is secured to arched beam 223 by one or more tethers 229*a*, 229*b*.

Figure 3:
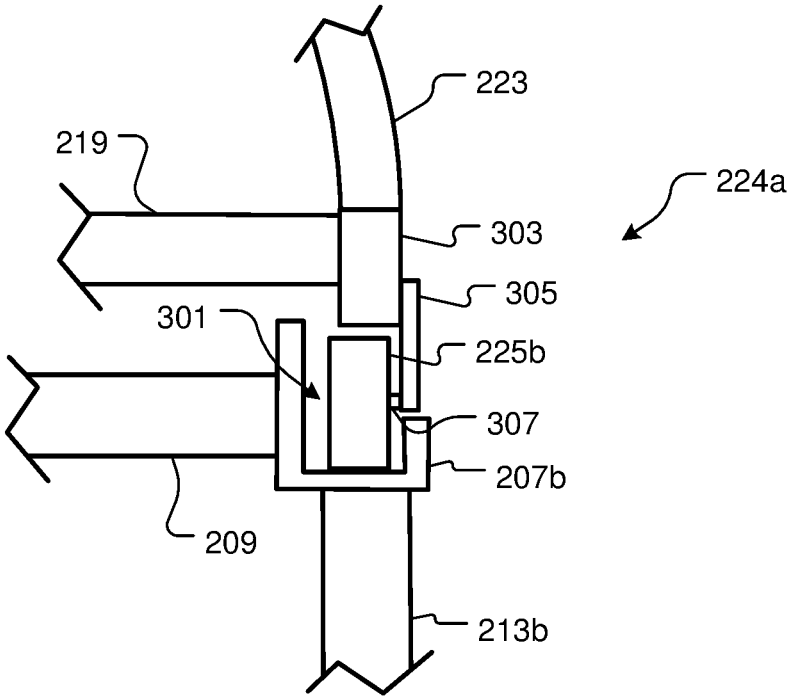
FIG. 3 is a front view of the retraction mechanism from FIGS. 2A and 2B.

In FIG. 3 a close up front view of one retraction point 224*b* is shown. In the preferred embodiment, guide track

207*b* forms a cavity 301 whereby the plurality of rollers 225*b* are slidingly engaged within cavity 301. Roller 225*b* is attached to an edge 303 of roof frame 219 by a connection member 305 secured to a stem 307, the stem inserted into and engaged with roller 225*b*.

Figure 4A:
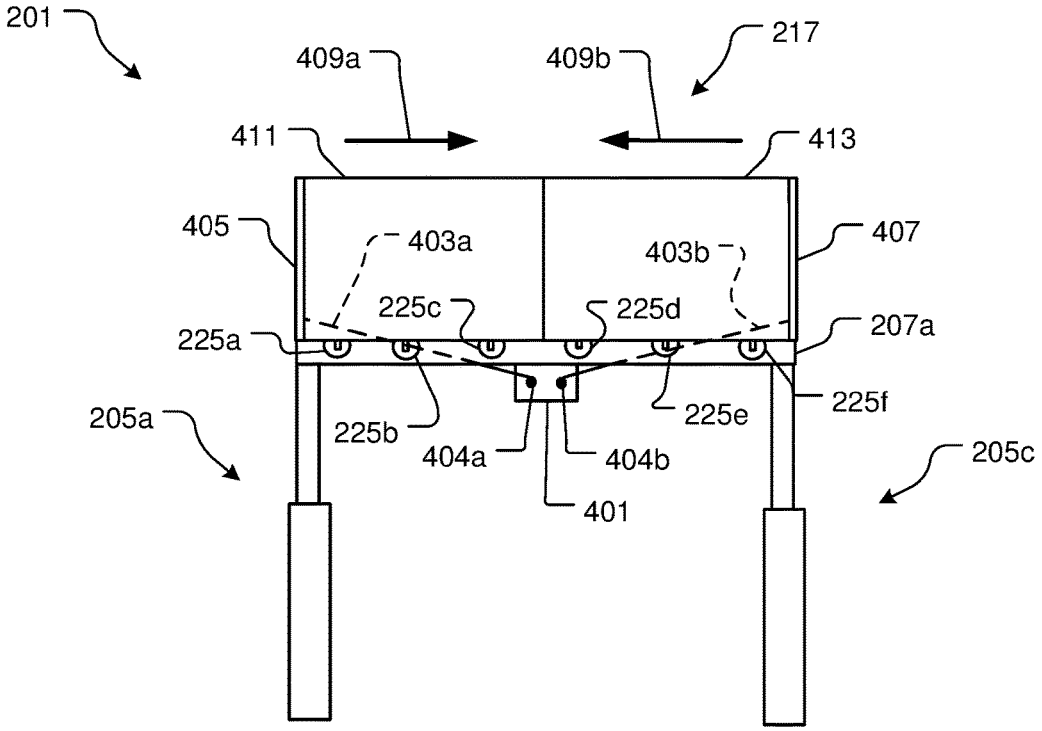
FIGS. 4A and 4B are side views of the retractable roof system of FIGS. 2A and 2B.
Figure 4B:
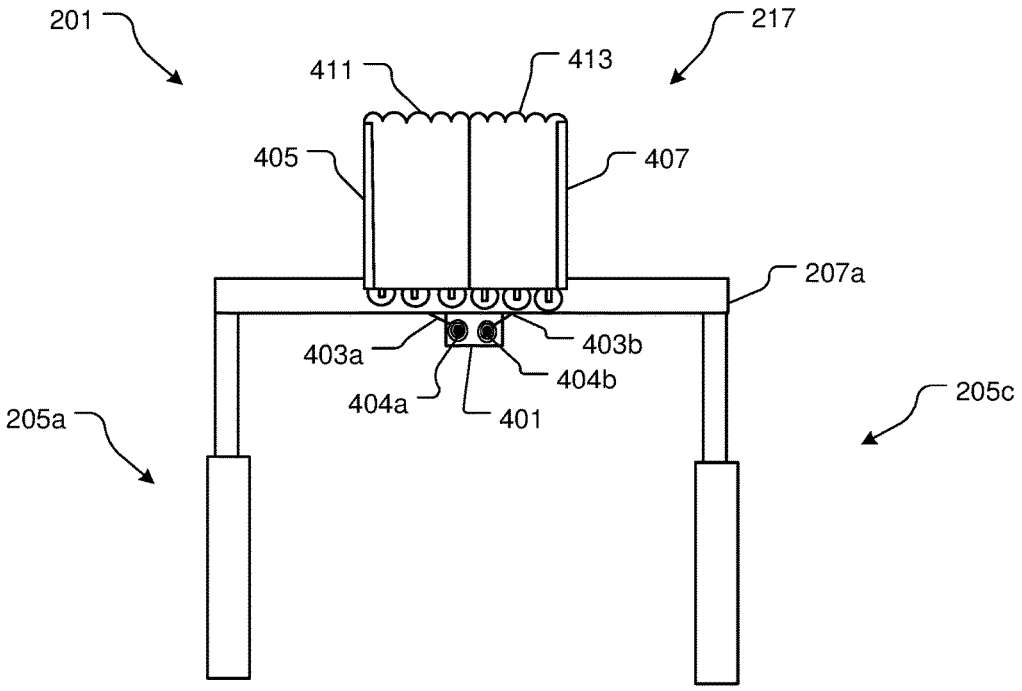

In FIGS. 4A and 4B, side views of system 201 are shown. In the preferred embodiment, a motor 401 is secured to pulleys 403*a*, 403*b* with retracting spools 404*a*, 404*b*. Pulleys 403*a*, 403*b* are tethered to the roof frame 219 at a first end 405 and a second end 407. During use, motor 401 applies pressure 409*a*, 409*b* to pulleys 403*a*, 403*b*, thereby pulling rollers 225*a-f* toward the center of system 201 and retracting roof 217 towards the middle of the guide tracks 207*a*, 207*b* while pulleys 403*a*, 403*b* are wound around retracting spools 404*a*, 404*b*.

It is contemplated that the flexible roof material 227 can further include multiple sections, such as one waterproof section 411 and one mesh section 413, thereby allowing for additional customization.

It should be appreciated that one of the unique features believed characteristic of the present application is the combination of features, including the plurality of pulleys 303*a*, 303*b* and the height altering legs, allowing for a retractable roof system with multiple adjustments and thereby being an improvement over prior art.

Figure 5:
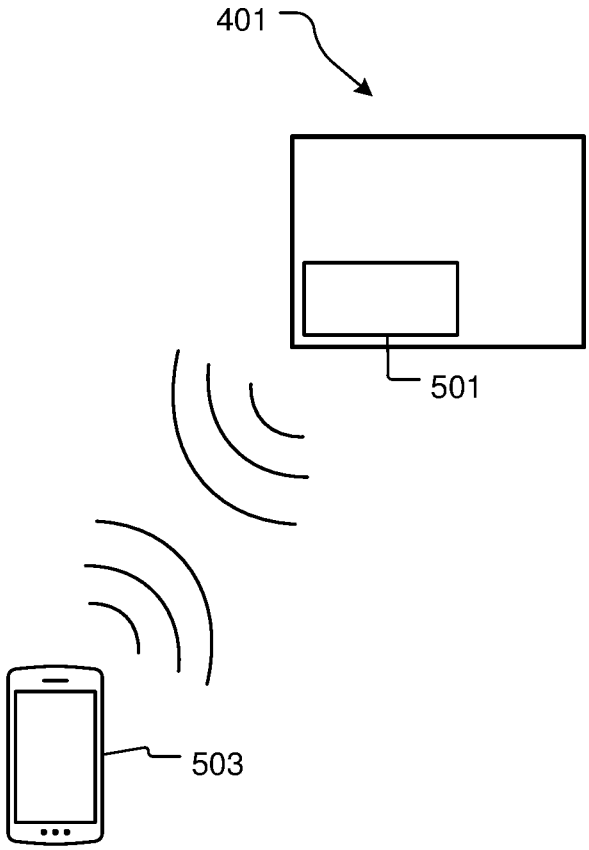
FIG. 5 is a simplified diagram of the retractable roof system of FIGS. 2A and 2B.

In FIG. 5 a simplified diagram of additional features contemplated to be incorporated into system 201 are shown. It is contemplated, that system 201 can further include a transceiver 501 disposed within motor 401 and configured to communicate wirelessly with an electronic device 503, whereby electronic device 503 is used to activate motor 401 from a distance, allowing for user control of system 201 from the distance. It is contemplated that the electronic device can be a mobile phone or remote configured to communicate with transceiver 501.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A retractable roof system, comprising:

a support structure, having:

a first vertical leg, a second vertical leg, a third vertical leg, and a fourth vertical leg extending upward from a ground surface;

a first guide track extending from the first vertical leg to the second vertical leg;

a second guide track extending from the third leg to the fourth leg;

a first support beam connecting the first vertical leg and the third vertical leg; and a second support beam connecting the second vertical leg and the fourth vertical leg;

a roof retractably secured on the support structure, the roof having:

a frame having a first edge aligned with the first track and a second edge aligned with the second track;

a plurality of rollers connected to the first edge and the second edge and configured to slidingly engage with the first track and the second track; and a flexible roofing material secured on the roof frame;

a pulley attached to the first end of the frame;

wherein force exerted on the pulley pulls a set of the plurality of rollers towards a center of the roof, causing a first end of the frame to retract.

2. The retractable roof system of claim 1, further comprising:

a second pulley connected to a second end of the frame;

wherein force exerted on the second pulley pulls the second end towards the center of the frame.

3. The retractable roof system of claim 1, wherein the flexible roofing material comprises:

a first portion composed of waterproof material; and a second portion composed of mesh.

4. The retractable roof system of claim 1, wherein each leg further comprises a telescoping device configured to allow a height of the leg to extend and retract.

5. The retractable roof system of claim 1, wherein the roof frame further comprises a plurality of arch supports extending from the first edge to the second edge and supporting the flexible roofing material.

6. The retractable roof system of claim 1, further comprising:

a motor configured to exert force on the pulley.

7. The retractable roof system of claim 6, further comprising:

a transceiver disposed within the motor.

8. The retractable roof system of claim 7, further comprising:

a remote, configured to activate the motor from a predetermined distance through the transceiver.

9. The retractable roof system of claim 7, further comprising:

an electronic device configured communicate wirelessly through a network with the transceiver.

* * * * *